United States Patent [19]

Litynski

[11] 4,365,439

[45] Dec. 28, 1982

[54] TOY LASER-TYPE GUN

[76] Inventor: Zbigniew Litynski, 5150 S. Newland Ave., Chicago, Ill. 60638

[21] Appl. No.: 183,001

[22] Filed: Sep. 2, 1980

[51] Int. Cl.[3] ..... A63H 33/26

[52] U.S. Cl. ..... 46/227; 273/310

[58] Field of Search ..... 46/227, 232, 1 E, 226, 46/228, 229, 175 R; 273/310, 311, 312; 42/54, 46, 273

[56] References Cited

U.S. PATENT DOCUMENTS

| | | | |
|---|---|---|---|
| 2,097,749 | 11/1937 | Wade | 46/175 R |
| 2,122,467 | 7/1938 | Heppner | 46/175 R |
| 2,168,454 | 8/1939 | Smith | 46/10 |
| 2,181,952 | 12/1939 | Schmarion | 46/232 |
| 2,208,313 | 7/1940 | Schmidt | 46/227 |
| 2,734,310 | 2/1956 | Christopher | 46/228 |
| 2,783,588 | 3/1957 | Charvat | 46/227 |
| 3,294,401 | 12/1966 | Nicholas et al. | 273/311 |
| 3,365,837 | 1/1968 | Butler et al. | 91/333 |
| 3,397,484 | 8/1968 | Ryan et al. | 46/175 AR |
| 3,508,751 | 4/1970 | Meyer et al. | 46/227 X |
| 3,570,176 | 3/1971 | Palmer | 46/227 |
| 3,707,055 | 12/1972 | Pearce | 46/228 |
| 4,171,811 | 10/1979 | Meyer et al. | 46/175 R X |
| 4,175,353 | 11/1979 | Pickett | 46/227 |
| 4,236,348 | 12/1980 | Dulac | 46/228 |

FOREIGN PATENT DOCUMENTS

| | | | |
|---|---|---|---|
| 1126279 | 3/1962 | Fed. Rep. of Germany | 46/227 |
| 563181 | 7/1977 | U.S.S.R. . | |

*Primary Examiner*—Mickey Yu

*Attorney, Agent, or Firm*—Wegner, McCord, Wood & Dalton

[57] ABSTRACT

A toy gun incorporates light and sound sources for simultaneous generation of light pulses and sounds reminiscent of an outer space laser gun when a trigger is depressed. Light transmission material in conjunction with a reflector, radiate and project the light pulses generated within the gun in two different directions. The electronic circuitry for generating the light pulses and the sounds is completely enclosed within the grip of the gun.

21 Claims, 5 Drawing Figures

9.v
1.5v
1.5v

Vc
VCO CONTROL
t →
VOUT
VCO OUTPUT
t →

T1
5
1
2
3
4
2μf
C1
Q1
D1
RATE OF FLASH ADJUSTER
R2
1MEG
T2
10μf
450v
C2
R3
56K
42
5.6K
R1
32
TRIGGER SWITCH
3v
38
1μf
250v
C3
NE1
A
C
G
SCR1

RATE CONTROL
C4
R6
1μf
5v
5v
.1μf
5v 28 27 26 25 24 23 22 21 20 19 18 17 16 15
SN76477
IC
1 2 3 4 5 6 7 8 9 10 11 12 13 14
5v
TRIGGER SWITCH
32
4.7 K
AMP SECTION
9v
Q3
R4
Q4
68
64
3.9K
R5
10μf

TOY LASER-TYPE GUN

BACKGROUND OF THE INVENTION

This invention relates to toy guns, and more particularly to toy guns which emit light pulses and sounds when a trigger is depressed.

Many toy guns utilize mechanical and/or electronic sound and light producing means which simulate gun-firing activity. One such apparatus utilizes a combination of a fiber plate and a striker which impinges thereon and which is controlled by an alternately switched electromagnetic relay to produce the sounds of a submachine gun while a light bulb is switched between on and off states.

A purely electrical sound and light producing apparatus in a toy machine gun employs the use of a phonograph record which is played when the trigger is actuated. A light bulb is concurrently switched on and off by a motor and commutator arrangement in response to the trigger actuation.

Other types of toy guns employing sound-producing apparatus utilize gunpowder caps, ratchet and striker assemblies or a discharge of compressed air to simulate the firing of a real gun. Still other toy guns incorporate visual effects apparatus, such as superimposition of a predetermined visual display on a real scene at which the gun is aimed by means of a film-strip which is projected onto a half-silvered mirror through which the real scene is visible.

SUMMARY OF THE INVENTION

According to the present invention, a light source is disposed within an inner chamber of a main body of the gun and is controlled by electronic circuitry located in the grip. First and second light transmission means are provided along with a reflector to direct and radiate the light pulses generated by the light source, thereby creating a pulsed lasertype effect.

The electronic circuitry also provides a frequency modulated signal to a speaker located at the rear of the gun when the trigger is depressed to provide sounds reminiscent of a space weapon at the same time the light source is flashing.

The invention will be further understood from the following description and drawings.

DESCRIPTION OF THE PREFERRED EMBODIMENT

Figures 1, 2:
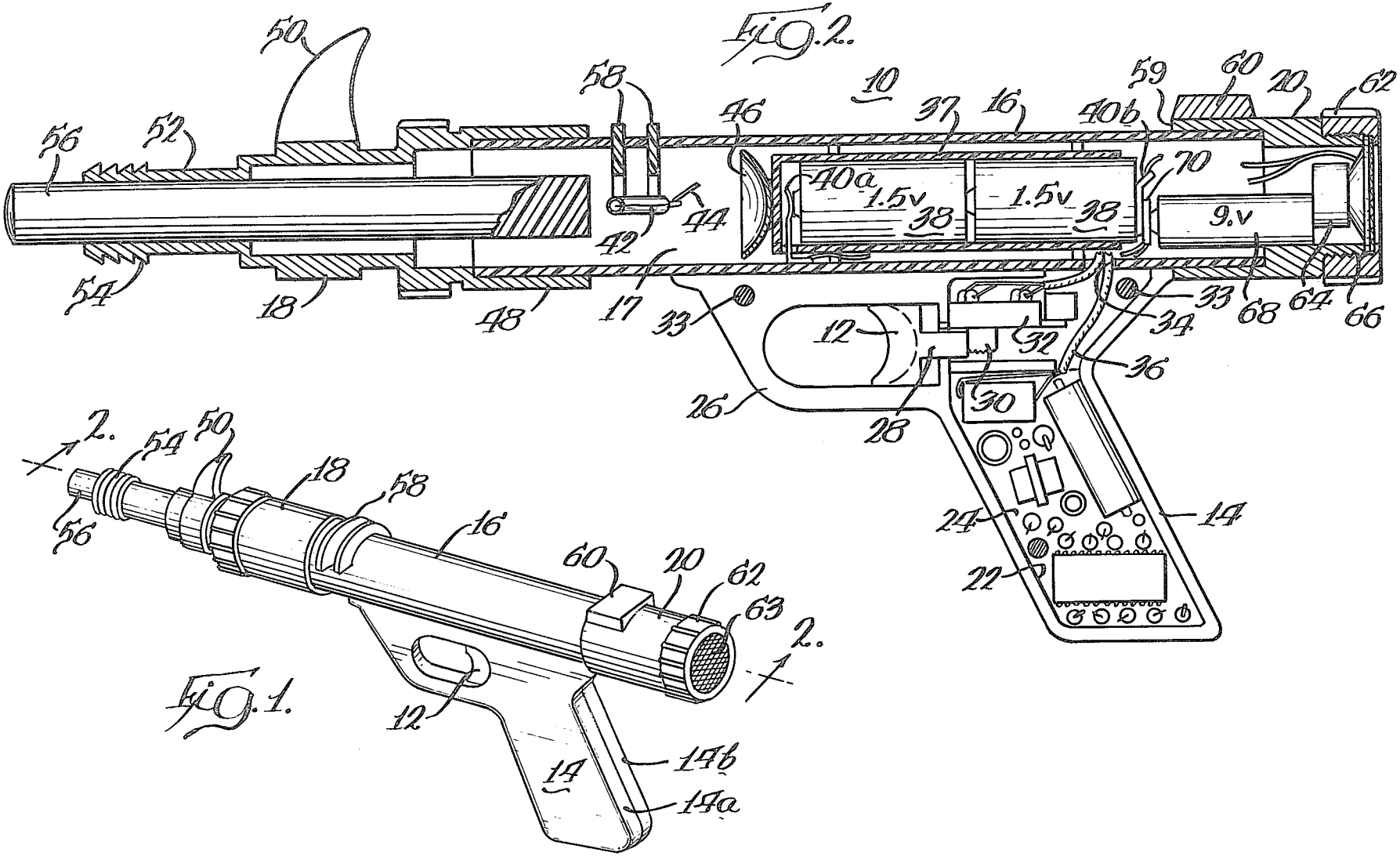
FIG. 1 is an elevational view partly in section of a toy gun embodying the invention.
FIG. 2 is a perspective view thereof.

Referring to FIGS. 1 and 2, there is illustrated a toy gun 10 which simultaneously emits pulses of light and generates sounds when a trigger mechanism 12 is depressed. The toy gun 10 referred to herein produces sound and visual effects which persons, and particularly children, commonly associate with futuristic weapons used in interstellar space. The toy gun 10 simultaneously emits pulses of light and produces eerie sounds which are reminiscent of weapons used by science fiction characters.

The toy gun 10 consists basically of four parts: a hand gripping portion 14, a housing or main body 16 having an inner chamber 17, a front end piece 18 and a rear end piece 20, which are joined to one another by means of glue, rivets, screws or other fastening means.

The grip 14 consists of two grip halves 14*a*, 14*b* each of which have hollowed-out portions 22 within which is mounted the electrical circuitry required to operate the light and sound sources. The electrical circuitry is mounted on a mounting board 24 and is secured by any suitable means within the hollowed portions 14*a*,14*b* of the assembled grip 14.

Also located within the grip 14 at the rear end of a finger guard 26 is the trigger mechanism 12, which has an actuating arm 28 bearing against an actuating button 30 of a trigger switch 32. The grip halves 14*a*,14*b* may be secured together by rivets 33 or by any suitable fastening means once the components are assembled therein.

The assembled grip portion 14 is secured directly to the main body 16 which has an aperture 34 through which electrical leads 36 from the electrical components enter the main body 16. The main body 16 is generally cylindrical in shape and encloses and supports a battery compartment 37 within which resides a pair of batteries 38. The batteries 38 may be conventional 1.5 volt, "C" cell size batteries. A pair of battery contacts 40*a*,40*b* are located at the front and rear respectively of the battery compartment 37 and serve to connect the batteries 38 to the electrical circuit located within the grip 14.

Secured and supported towards the front of the main body 16 is light source 42, which may be a gaseous discharge flash tube. The flash tube 42 is connected to the electrical components located in the grip 14 by means of flash tube leads 44. Mounted on the front surface of the battery compartment 37 behind the flash tube 42 is a reflector 46 which directs and concentrates the light generated by the flash tube 42 out the front and along the axis of the main body 16.

Attached to the front end of the main body 16 is the front end piece 18 which has a sleeve 48 into which the front portion of the main body 16 is inserted and secured by means of glue or other securing means. The front end piece 18 is generally cylindrical in shape and has on its top surface a front sight 50 which is used to assist in aiming the gun 10. A barrel 52 is located in front of the front sight 50 and has a set of decorative tapered flanges 54 disposed about its periphery at its front end.

A first light transmission means 56, which may be preferably a solid light transmitting cylinder, such as a plexiglass tube, or which may be a bundle of fiber or filament optics, is mounted within the barrel 52 and is oriented in the axial direction of the barrel 52. The transmission means 56 guides and projects a major portion of the light pulses developed by the flash tube 42 and reflected by the reflector 46 axially of the main body 16 and the barrel 52.

A second light transmission means consisting of a pair of plexiglass inserts, or fins, 58 are mounted within the wall of the main body 16 and extend into the inner chamber 17 directly above the flash tube 42. The second light transmission means 58 transmits a major portion of the light pulses developed by the flash tube 42 out the top of the main body 16 transverse to its axis.

The combination of the first and second light transmission means 56 and 58 produces a dual lighting effect, which is enhanced by the use of the light-directing materials. The use of plexiglass or fiber optics causes the light pulses to be projected in two directions, for example, on the wall and ceiling of a room.

Mounted at the rear of the main body 16 is the rear end piece 20 which has a sleeve 59 into which is inserted the rear of the main body 16 and secured thereto. A rear sight 60 is located on top of the rear end piece 20 and is used in cooperation with the front sight 50.

A rear cap 62 having a series of perforations 63 extending therethrough to allow sounds to escape is threadably secured to the rear end piece 20 and holds in place a sound producing means, such as a speaker 64, against a back end surface 66 of the rear end piece 20. The speaker 64 in turn holds in place a 9-volt battery 68 against an insulating strip 70 which bears against the battery contact 40*b*. The 9-volt battery 68 and the speaker 64 are connected by means of the leads 36 to the electronic circuitry located in the grip 14.

Figure 4:
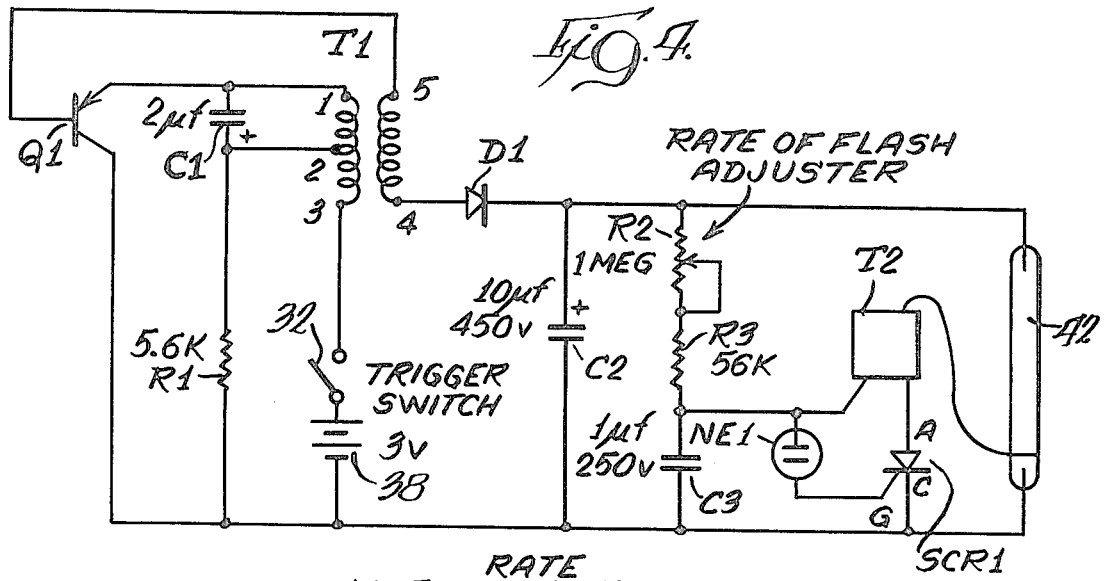
FIG. 4 is a schematic diagram of a circuit for flashing the light source.

Referring also to FIG. 4, there is illustrated the electronic circuitry used to generate the pulses of light from the flash tube 42. When the trigger switch 32 is closed by depressing the trigger 12, the batteries 38, which together comprise a 3-volt power source, are coupled to the primary winding of a transformer T1. A capacitor C1, coupled across two of the contacts in the primary winding of T1, begins to charge through the primary of T1 and through the emittor-collector circuit of a transistor Q1. When the capacitor C1 has charged to a particular voltage, the transistor Q1 becomes reverse-biased and turns off, allowing the capacitor C1 to discharge through the resistor R1. Once the capacitor C1 discharges, the transistor Q1 is turned back on and the cycle repeats itself. This alternate charging and discharging of the capacitor C1, which causes the transistor Q1 to turn on and off, provides pulses of current to the secondary of T1 through the base of the transistor Q1.

The current pulses appearing at the secondary of the transformer T1 are stored in a capacitor C2. A diode D1 prevents the charge stored on the capacitor C2 from discharging back through the secondary of the transformer T1. The flash tube 42 is connected directly across the terminals of the capacitor C2 to provide a voltage potential for causing a flash when a triggering signal is applied thereto.

The triggering signal for the flash tube 42 is provided by a potentiometer R2, a resistor R3, and a capacitor C3, which accumulates the charge developed in the secondary winding of the transformer T1. When the voltage on the capacitor C3 builds up to approximately 90 volts, a neon tube NE1 fires, which in turn gates into conduction a silicon controlled rectifier SCR1. When the SCR1 fires, a second transformer T2 steps up the incoming voltage and applies a pulse of approximately 4,000 volts to the flash tube 42, causing a bright flash.

Once the flash tube 42 has fired, the entire sequence repeats again and the frequency of repetition can be varied by adjusting the wiper of the potentiometer R2, causing a corresponding change in the charging rate of the capacitor C3.

Figure 3:
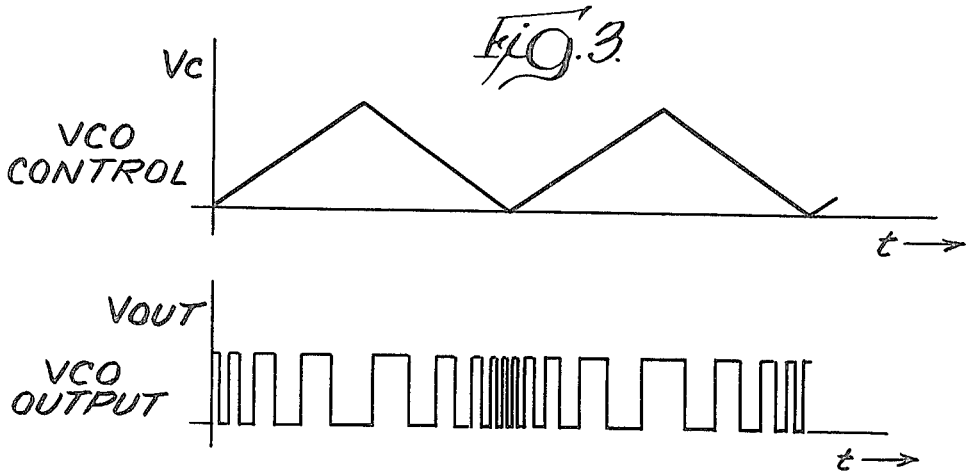
FIG. 3 is a waveform diagram of the control and output signals used to produce the sounds generated within the gun.
Figure 5:
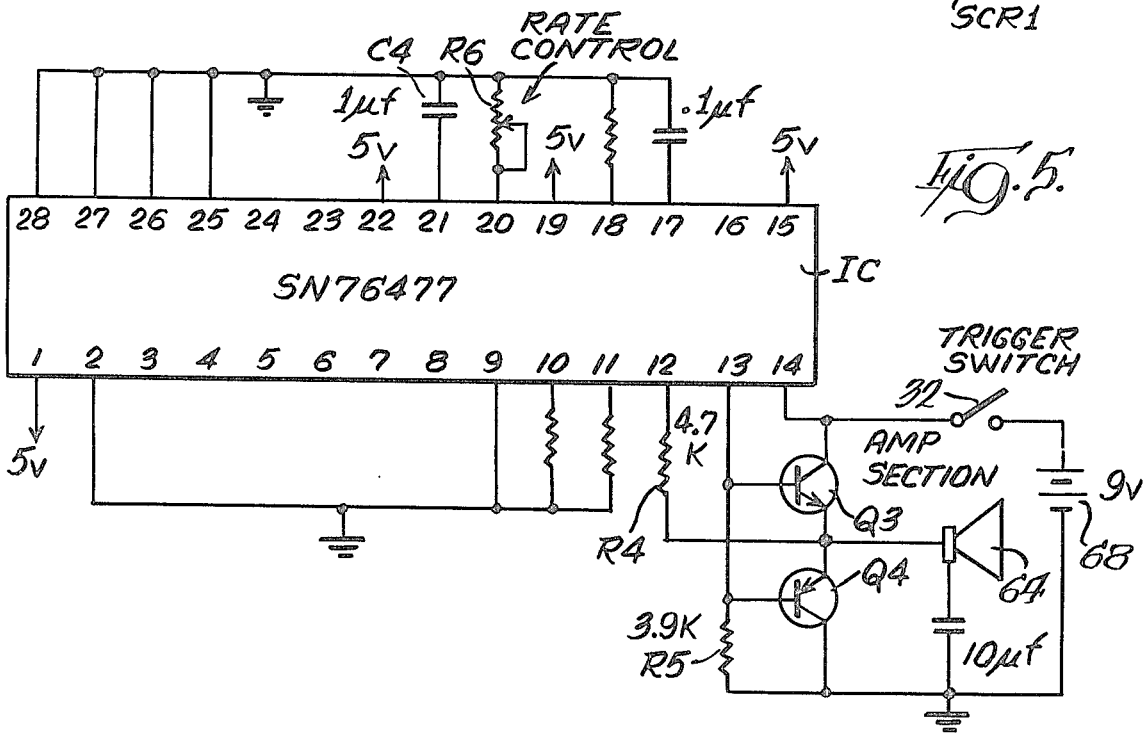
FIG. 5 is a circuit for generating the frequency modulated signal which is supplied to the speaker.

Referring now to FIGS. 3 and 5, there is illustrated a circuit for generating a frequency modulated tone which, together with the speaker 64, serves as the sound generating apparatus of the toy gun 10.

The circuit for generating the frequency modulated sound may be implemented by utilizing an SN76477N integrated circuit, or IC, complex sound generator manufactured by Radio Shack. The IC may be programmed by external components to provide the sound desired.

The complex sound generator IC has an internal voltage controlled oscillator, or VCO, which is controlled by an internally generated ramp signal. As illustrated in FIG. 3, the frequency of the output, which is generated at a pin P13 on the IC, is inversely related to the voltage of the control signal, i.e. the higher the voltage applied to the VCO, the lower the frequency of the output.

The VCO output signal appearing at the pin P13 drives a conventional push-pull configuration amplifier section consisting of transistors Q3 and Q4 and a resistor R5. The speaker 64 is connected between the emitters of the transistors Q3 and Q4, as is a feedback resistor R4 which is connected to a pin P12.

The frequency modulated sound is provided by the speaker 64 when the trigger switch 32 is closed, thereby applying a proper biasing voltage to the transistors Q3 and Q4 from the 9-volt battery 68.

The slope of the VCO control signal, and hence the rate of change of the frequency of the VCO output signal, can be controlled by appropriate selection of a capacitor C4, which is connected from a pin P21 to ground, and by proper adjustment of the wiper of a potentiometer R6, which is connected from a pin P20 to ground.

The frequency of the sound generated by the sound generator and the rate of flashing of the lamp 42 may be adjusted by the user by providing actuating knobs which extend outside of the gun itself and which control the wipers of the potentiometers R2 and R6. Alternatively, the settings of these potentiometers may be preset and fully enclosed within the grip 14 so as not to be user-adjustable.

Moreover, the circuitry for controlling the lamp 42 and the sound circuitry may be modified to produce a single-shot sound and light effect, rather than continuous flashing and sound generation, each time the trigger 32 is depressed.

Although the toy gun 10 referred to herein has been illustrated and described as taking the form of a pistol, the invention can take the form of a rifle, sub-machine gun or a space cannon by modifying somewhat the external appearance thereof. Moreover, the inventive concepts embodied herein need not be limited to use in a toy gun, but may be used in other applications where simultaneous generation of sounds and projected light pulses is desired.

I Claim:

1. A toy gun having a generally cylindrical main body secured to a grip for simultaneously producing sounds and emitting light pulses when a trigger is depressed, comprising:

a front end piece secured to a front portion of said main body and having a barrel;

a light source secured within said main body;

first light transmission means secured within said barrel and extending into said main body on one side of said light source for transmitting light pulses developed by said light source along the axis of said cylindrical main body;

a rear end piece secured to a rear portion of said main body and having a back end surface;

sound producing means secured to said back end surface; and actuation means for simultaneously actuating said light source and said sound producing means in response to said trigger depression.

2. The toy gun of claim 1, further including second light transmission means secured within a wall of said main body and extending therein for transmitting said light pulses transverse to the axis of said cylindrical main body.

3. The toy gun of claim 2 in which the light source is a gaseous discharge flash tube positioned in the main body for simultaneous light communication with the first and the second light transmission means.

4. The toy gun of claim 1, wherein said front end piece includes a front sight and said rear end piece includes a rear sight for assisting aiming of said toy gun.

5. The toy gun of claim 1, further including mounting means for mounting said actuation means within said grip whereby said actuation means is fully enclosed therein.

6. The toy gun of claim 1, wherein said actuation means includes sound signal means for driving said sound producing means with a frequency modulated signal when said trigger is depressed.

7. The toy gun of claim 1, further including reflection means disposed within said main body on the other side of said light source opposite said first light transmission means for directing and concentrating said light pulses into said first light transmission means.

8. The toy gun of claim 1 in which the light source is a gaseous discharge flash tube.

9. The toy gun of claim 8 in which the sound producing means is positioned within said main body rearwardly of the gaseous discharge flash tube.

10. The toy gun of claim 1 in which the first light transmission means is a solid rod having the optical property of directing and radiating a major portion of the light from the light source axially of the rod.

11. The toy gun of claim 10 in which a fin of light transmitting material is positioned transversely of the main body, the fin being in light communication with the light source so that light is simultaneously emitted from the fin and from the solid rod when the light source is actuated.

12. The toy gun of claim 11 in which the light source is a gaseous discharge flash tube.

13. The toy gun of claim 1 in which the actuation means successively and intermittently actuates the light source and the sound producing means by a single depression of the trigger.

14. The toy gun of claim 1 in which the actuation means is provided with adjustable means to vary the frequency of actuation of the light source.

15. The toy gun of claim 13 or 14 in which the light source is a gaseous discharge flash tube.

16. The toy gun of claim 15 in which the actuation means is provided with second adjustable means to vary the frequency of the sound generated by the sound producing means.

17. A toy gun having a generally cylindrical main body secured to a grip for simultaneously producing sounds and emitting light pulses when a trigger is depressed, comprising:

a front end piece secured to a front portion of said main body and having a barrel;

a light source secured within said main body;

first light transmission means secured within said barrel and extending into said main body in front of said light source for transmitting light pulses developed by said light source along the axis of said cylindrical main body;

second light transmission means secured within a wall of and extending into said main body for transmitting said light pulses transverse to the axis of said main body;

reflection means disposed within the main body behind said light source opposite from said first light transmission means for directing and concentrating said light pulses into said light transmission means;

a rear end piece secured to a rear portion of said main body and having a back end surface;

sound producing means secured to said back end surface; and actuation means for simultaneously actuating said light source and said sound producing means in response to said trigger depression.

18. The toy gun of claim 17, wherein said front end piece includes a front sight and said rear end piece includes a rear sight for assisting aiming of said toy gun.

19. The toy gun of claim 17, further including mounting means for mounting said actuation means within said grip whereby said actuation means is fully enclosed therein.

20. The toy gun of claim 17, wherein said actuation means includes sound signal means for driving said sound producing means with a frequency modulated signal when said trigger is depressed.

21. A toy gun having a generally cylindrical main body secured to a grip for simultaneously producing sounds and emitting light pulses when a trigger is depressed, comprising:

sound producing means for generating sounds in response to a first output signal;

a light source secured within said main body for producing light pulses in response to a second output signal;

a cylindrical first light transmission means partially disposed within said main body for transmitting said light pulses parallel to the axis of said main body;

second light transmission means partially disposed within a wall of and extending out of said main body for transmitting said light pulses transverse to the axis of said main body;

actuating means coupled to said sound producing means and said light source for simultaneously providing said first and second output signals when said trigger is depressed;

a rear end piece secured to a rear portion of said main body; and a rear end cap having a series of perforations for securing said sound producing means against said rear end piece while allowing sounds developed by said sound producing means to escape said gun.

* * * * *